United States Patent [19]

Kobayashi et al.

[11] 4,024,085

[45] May 17, 1977

[54] GUM REMOVING SOLUTION FOR LITHOGRAPHIC PLATE

[75] Inventors: Kesanao Kobayashi; Hiroshi Matsumoto, both of Odawara, Japan

[73] Assignee: Fuji Photo Film Co., Ltd., Minami-ashigara, Japan

[22] Filed: Oct. 3, 1974

[21] Appl. No.: 511,856

[30] Foreign Application Priority Data

Oct. 3, 1973 Japan ..... 48-111303

[52] U.S. Cl. ..... 252/136; 101/451; 101/466; 134/38; 134/40; 252/89 R; 252/142; 252/145; 252/170; 252/173; 252/524; 252/542; 252/DIG. 8

[51] Int. Cl.[2] ..... C11D 7/08; C11D 7/16; C11D 7/32; C11D 7/50

[58] Field of Search ..... 252/136, 142, 145, 170, 252/89, 173, 524, 542, DIG. 8; 134/38, 40; 101/451, 466

[56] References Cited

UNITED STATES PATENTS

| | | | |
|---|---|---|---|
| 2,374,070 | 4/1945 | Barensfield | 101/451 |
| 2,687,346 | 8/1954 | McDonald | 252/136 X |
| 2,763,553 | 9/1956 | Clark | 101/466 |
| 3,053,178 | 9/1962 | Greubel | 101/451 |
| 3,114,641 | 12/1963 | Sperti | 426/599 |
| 3,150,096 | 9/1964 | Schmidt | 252/136 X |
| 3,211,659 | 10/1965 | Pikaar | 252/136 |
| 3,373,115 | 3/1968 | Steppan | 252/153 |
| 3,522,062 | 7/1970 | Shimizu | 101/451 X |
| 3,532,599 | 10/1970 | Cooperman | 134/38 X |
| 3,551,230 | 12/1970 | Hansen | 156/71 |
| 3,627,685 | 12/1971 | Lam | 252/100 |
| 3,658,552 | 4/1972 | Carlson | 426/590 X |
| 3,676,353 | 7/1972 | Ciko | 252/136 |
| 3,679,479 | 7/1972 | Ray | 134/40 |
| 3,764,353 | 10/1973 | Shimizu | 101/451 X |
| 3,769,043 | 10/1973 | Morishima | 101/451 X |
| 3,826,829 | 7/1974 | Marulich | 426/590 |
| 3,829,319 | 8/1974 | Suzuki | 106/2 |

FOREIGN PATENTS OR APPLICATIONS

| | | | |
|---|---|---|---|
| 1,958,857 | 10/1971 | Germany | 252/136 |

*Primary Examiner*—Dennis L. Albrecht
*Attorney, Agent, or Firm*—Sughrue, Rothwell, Mion, Zinn & Macpeak

[57] ABSTRACT

A gum removing solution for a lithographic plate containing at least one compound selected from the group consisting of compounds containing

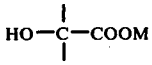

linkage where M represents a hydrogen atom, an ammonium group or an alkali metal atom and cyclic esters and cyclic amides having 3 to 6 carbon atoms. The solution can further contain at least one compound selected from the group consisting of phosphoric acid and polyphosphoric acid and the metal salts and ammonium salts of these acids, and optionally a water-soluble colloid. The solution has a pH of 1 to 5.5.

6 Claims, No Drawings

GUM REMOVING SOLUTION FOR LITHOGRAPHIC PLATE

BACKGROUND OF THE INVENTION

1. Field of the Invention

This invention relates to a gum removing solution facilitating the removal of a gum material which is applied to a lithographic plate for protecting the non-image part thereof.

2. Description of the Prior Art

Lithography is a printing system where the hydrophilic property of the image area of a printing plate is utilized, and, after development, a process has generally been practiced in lithography in which a developing ink is applied to the image areas and a gum solution is applied to the non-image areas, for the purpose of maintaining and reinforcing the properties of both of these areas. The gum solution comprises an aqueous solution of gum arabic, cellulose gum or a water-soluble high molecular weight substance containing carboyl groups in the molecule, and optionally contains a pH adjusting agent and/or an antiseptic. The object of the gum solution is not only to protect the hydrophilic property of the non-image areas but also to protect the areas from stains and scratches resulting from a retouching of the other image areas such as when changes or erasures are made, or from adhesion of fingerprints, fats and oils and dust thereto occurring during storage of the printing plates between producton and uses for printing, or storage for re-use or during installation on a printing machine, or, that is, to prevent the occurrence of any oxidative stains. oxidative stains are those phenomona which occur, when the printing plate is made of a metal plate such as an aluminum or zinc plate, and the surface of the metal plate is oxidized after the surface has been exposed continuously for a long period of time during manufacture of the plate or during printing with the plate, causing the occurrence of spotted ink stains on the surface, and these stains can be prevented by provision of a gum coating on the surface of the printing plate.

The gum coating is preferably easily removed on a printing machine, and in particular, this is desirably completely removed in a short period of time. The reason for this is the organophilic property (or ink receptivity) of the image area is extremely degraded, if the gum coating remains in an image area during printing.

Recently, a process has been developed where the conventional step for application of a developing ink to an image area is omitted to reduce the late making steps or to save labor. In such a process, however, the gum tends to adhere to the image area, and the gum adhered to the image area is often difficult to remove. As one labor-saving means, a process has been devised where the protection of both the oleophilic property of the image area and the hydrophilic property of the non-image area is simultaneously carried out in one step. The gum solution used in this process in general contains an emulsified oleophilic material therein. When such a gum solution is actually used, however, the gum adhering to an image area is more difficult to remove than the gum contained in an aqueous soluton of gum arabic only.

SUMMARY OF THE INVENTION

Accordingly, an object of this invention is to provide a gum removing solution capable of facilitating the removal of a gum coating provided for protection of a non-image area of a lithographic plate.

More precisely, this invention provides a gum removing solution containing at least one compound selected from the group consisting of (i) compounds having a

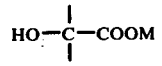

linkage in the molecule, where M represents a hydrogen atom, an ammonium group or an alkali metal atom, (ii) cyclic esters having 3 to 6 carbon atoms and (iii) cyclic amides having 3 to 6 carbon atoms. The gum removing soluton can optionally contain in addition to these compound(s) at least one compund selected from the group consisting of phosphoric acid and polyphosphoric acid and the metal salts and ammonium salts of these acids and, if desired, a water-soluble colloid.

DETAILED DESCRIPTION OF THE INVENTION

The compounds having a HO—C—COOM linkage in the molecule where M is a hydrogen atom, an ammonium group or an alkali metal atom such as a sodium atom, a potassium atom, etc. are oxy acids and preferred compounds for use in this invention are compounds of the following formula (I)

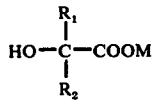

(I)

wherein $R_1$ and $R_2$ each represents a hydrogen atom or an alkyl group preferably having 1 to 4 carbon atoms (such as a methyl, ethyl, propyl or isopropyl group), or a substituted alkyl group preferably having 1 to 4 carbon atoms and substituted with at least one of a hydroxyl group and a carboxyl group (for example, a hydroxyalkyl group such as a hydroxymethyl, hydroxyethyl, hydroxypropyl or hydroxybutyl group; or a carboxyalkyl group such as a carboxymethyl, carboxyethyl, carboxypropyl or carboxybutyl group; or an alkyl group substituted with both carboxyl and hydroxyl groups such as a carboxyhydroxymethyl, 1-carboxy-1-hydroxyethyl or 2-carboxy-2-hydroxyethyl group), and M has the same meaning as defined above. Representative examples of these compounds of the formula (I) are lactic acid, citric acid, tartaric acid, Rochelle salt, hydroxyacetic acid, sodium citrate, potassium citrate, ammonium citrate, sodium lactate, ammonium lactate and potassium lactate.

Examples of cyclic esters and cyclic amides having 3 to 6 carbon atoms which can be used in the present invention are propiolactone, butyrolactone, valerolactone, propiolactam, valerolactam, hexanolactone, pyrrolidone, methylpyrrolidone and γ-caprolactone.

The gum removing solution of this invention desirably contains (b) at least one compound selected from the group consisting of phosphoric acid and polyphosphoric acid and the metal salts and ammonium salts of these acids, and if desired, (c) a water-soluble colloid as an additional component(s).

These phosphoric acids and polyphosphoric acids include compounds of the formula $(HPO_3)x\ (H_2O)y$, where $x$ is an integer of 1 to 20 and $y$ is 0 or 1, and examples thereof are orthophosphoric acid, pyrophosphoric acid, metaphosphoric acid, tripolyphosphoric acid, tetraphosphoric acid, hexaphosphoric acid, decaphosphoric acid and eicosaphosphoric acid. Metal salts of these phosphoric acids and polyphosphoric acids which can be used in the present invention can be any compounds which are soluble in an acidic aqueous solution having a pH of about 5.5 or less. Examples of these metal salts are the alkali metal salts such as the sodium or potassium salt and the magnesium, iron and zinc salts, and in particular, sodium and potassium salts are preferred. Metal salts and ammonium salts of phosphoric acid and polyphosphoric acid can be incorporated in the gum removing solution of this invention by adding the corresponding phosphoric acid or polyphosphoric acid and ammonia or the corresponding metal hydroxide or chloride thereto. At least one compound selected from the group consisting of these phosphoric acids and polyphosphoric acids and the metal salts and ammonium salts of these acids is suitably incorporated in the gum removing solution of this invention in an amount of about 0.3 to 15% by weight, more preferably 0.4 to 7% by weight. A most preferred embodiment is a combination of (I) at least one compound selected from the group consisting of the metal salts and ammonium salts of phosphoric acid and the metal salts and ammonium salts of polyphosphoric acid and (II) phosphoric acid, and in particular, where the proportion of (I) to (II) is preferably about 0.1 to 10% by weight, more preferably 0.2 to 5% by weight, of (I) to about 0.2 to 5% by weight, more preferably 0.2 to 2% by weight, of (II).

The gum removing solution of this invention desirably contains additionally a water-soluble colloid. The water-soluble colloid can be any of the conventional colloids which are known as an agent for rendering a lithographic plate hydrophilic, and one representative example thereof is gum arabic. In addition, gums made from cellulose which are known as cellulose gum (as described in *Offset Platemaking Surface* edited by Robert F. Reed and published by Graphic Arts Technical Foundation, Inc., page 114, line 32), for example, carboxymethyl cellulose, hydroxyethyl cellulose, starch, sodium alginate, etc., can also be used as the water-soluble colloid. The content of the water-soluble colloid contained in the gum removing solution of this invention is preferably about 0.1 to 28% by weight, more preferably 0.4 to 18% by weight.

The pH of the gum removing solution of this invention is adjusted desirably in the range of about 1 to 5.5, and the gum removing solution of the present invention is most effective in this pH range. Suitable examples of pH adjusting agents include mineral acids such as phosphoric acid and hydrofluoric acid and organic acids such as organic sulfonic acids, organic carboxylic acids and organic phosphonic acids, with phosphoric acid being most preferred. Since the agent is used for adjusting the pH to the range of about 1 to 5.5, if the pH initially ranges from 1 to 5.5, no pH adjusting agent need be added.

In removing a gum coating on a printing plate with the gum removing solution of the present invention, the gum component adhering to an image area of the plate can easily be removed. Another surprising advantage is that the treatment of a printing plate with the gum removing solution of this invention brings about an improvement in applicability of an ink to an image area of the plate. Although it is not completely clear why the present gum removing solution results in this effect, it has been clarified that a gum removing solution containing at least one member selected from the group consisting of oxyacids where 1 carbon atom is substituted with both a hydroxyl group and a carboxyl group or a salt thereof and cyclic esters and cyclic amides having 3 to 6 carbon atoms has a particularly excellent effect.

Combining these compounds with at least one compound selected from the group consisting of phosphoric acids and polyphosphoric acids and the alkali metal salts and ammonium salts thereof, and optionally a water-soluble colloid, the above-mentioned effect can be enhanced even further and another effect of desensitizing the non-image area is imparted by the gum removing solution. Thus, the operational efficiency of the solution is improved and the hydrophilic property of the non-image area can be improved due to this desensitizing effect.

In lithography, in general, the surface of a printing plate is wet with an etching solution having a desensitizing effect, prior to beginning the printing, to prevent an occurrence of stains in the background. However, the above described gum removing solution of this invention has both a gum removing effect and a desensitizing effect, and therefore, printing can be begun immediately after a printing plate is wiped with this solution. This is particularly advantageous in that the appliability of a printing ink to a printing plate is improved, that is, the waste of papers at the beginning of printing is reduced (economization), and that the removal of gum and etching of the printing plate can be effected simultaneously in one step (labor-saving). Also the gum removing solution diluted with water can be used as a wetting water with excellent effects.

Conventional compositions of this kind which have been generally used contain chromium ion in the form of chromic acid or a dichromate, but the compositions of this invention do not contain harmful substances such as chromium ion and these are advantageous from the standpoint of prevention of environmental pollution.

When the solution of this invention is used as a wetting solution applied to the printing surface during printing, the solution of this invention is preferably diluted with water by about 15 to 20 times. The optimum degree for dilution depends upon the composition of the solution selected and the kind of printing plate used. For example, when an ordinary lithographic plate whose support is an aluminum plate is to be treated, it is preferred to dilute the composition of the components (a), (b) and (c) with water in a proportion of 1 part by volume of the composition to 30 parts by volume of water. By applying the thus diluted composition to the aluminum lithographic plate, prints of excellent quality can be obtained.

The gum removing solution of this invention is used in the following manner. A developed and gummed lithographic plate is set in a printing machine and properly placed therein, and, after completion of the arrangement for printing, the printing surface of the plate is rubbed with a sponge or absorbent cotton absorbing a gum removing solution to remove a gum component therefrom. No specific treatment is necessary in this operation, and this gum removing treatment is not different at all from other conventional gum removing operations which have been widely employed heretofore. After the whole printing surface has been rubbed, the printing machine is immediately started to begin the printing operation. No other treatment for removing the applied gum removing solution or for etching the printing plate with an etching solution is necessary.

This invention will be explained in greater detail by reference to the following Examples. All parts and percentages are by weight unless otherwise specifically indicated.

EXAMPLE 1

A 3S aluminum plate was dipped in a 10% aqueous solution of sodium tertiary phosphate (kept at 80° C) for 3 minutes for degreasing and then washed with water, and afterwards this was treated with a 70% nitric acid solution for de-smutting. After washing with water, the plate was successively dipped in a 0.2% potassium fluorozirconate aqueous solution (80° C) for 3 minutes whereby the surface of the aluminum plate was rendered hydrophilic. After the aluminum plate was again washed with water and dried, a light-sensitive solution of the following components was applied to the surface of the plate in an amount of 1 g/m² (after drying).

| | parts by weight |
|---|---|
| Shellac | 18 |
| Xylene Resin (condensation product of xylene and formaldehyde) | 3 |
| Diazo Resin (condensation produce of p-diazodiphenylamine and p-toluene sulfonate and formaldehyde) | 3 |
| Furfuryl Alcohol | 50 |
| Methanol | 300 |

The light-sensitive lithographic plate thus prepared was exposed to a carbon arc lamp (30 Amp) for 2 minutes at a distance of 70 cm through an original image. Next, a sufficient amount of a plate treating agent of the following components was spread over the printing surface of the plate, and then the surface was lightly rubbed with an absorbent cotton or gauze whereby the non-exposed part only was removed. Next, after the excess treating agent was removed from the surface of the plate, the treating agent still remaining on the surface was wiped with a dry and soft cloth in the same manner as the gumming and the surface was dried.

| | parts by weight |
|---|---|
| Isopropyl Alcohol | 160 |
| Benzyl Alcohol | 30 |
| Castor Oil | 12 |
| Sorbitan Monooleate | 5 |
| 14° Be Gum | 230 |
| Water | 500 |

After the lithographic plate thus obtained was left at room temperature (about 20°–30° C) for 5 days, the plate was placed in a multilith 1250 type printing machine (sold by Nippon Addressograph-Multigraph Corp.), the surface of the plate was rubbed with an absorbent cotton absorbing a gum removing solution of the following components (pH: 5.2), and the printing machine was run with the surface of the plate still wet.

In the first place, a wetting water roller was run, and then the feeding of papers and the running of an ink roller were carried out simultaneously. Counting the number of papers used until prints of a good quality were obtained from the beginning of printing, a print in which the whole image range was fully inked in the same density was obtained after the first 5 to 6 prints.

| Composition of Gum Removing Solution | |
|---|---|
| γ-Butyrolactone | 30 g |
| Phosphoric Acid (85%) | 3.0 g |
| Sodium Tertiary Phosphate | 2.2 g |
| Water to make | 500 ml |

On the other hand, another lithographic plate prepared as above was left at room temperature for 5 days and then placed in the multilith 1250 type printing machine in the same manner as above. Afterwards, the surface of the plate was rubbed with an absorbent cotton absorbing water with the same degree of pressure as in the previous procedure, and then the surface was etched with an etching solution consisting of the following components. In the same manner as in the previous procedure, the number of papers used until a print which was uniformly inked was obtained was counted. As a result, a print which was same as that obtained in the previous procedure after the first five to six prints was obtained after the first 12 to 15 prints.

From these results, the effect of the gum removing solution of this invention is clear.

| Composition of Etching Solution | |
|---|---|
| Ammonium Bichromate | 9.3 g |
| Phosphoric Acid (85%) | 5 ml |
| Magnesium Nitrate | 47.5 g |
| Gum Arabic 14° Be | 220 ml |
| Pure Water to make | 1000 ml |

EXAMPLE 2

20 parts by weight of shellac and 3 parts by weight of a diazo resin prepared by condensation of p-diazodiphenylamine p-toluenesulfonate and formaldehyde were dissolved in 30 parts by weight of dimethylformamide to prepare a solution of the diazo resin. On the other hand, an aluminum plate, designated 2S, was immersed for 3 minutes in a 10% aqueous solution of trisodium phosphate at 80° C for 3 minutes to degrease it and washed with water. Then, the plate was treated with a 70% nitric acid solution and washed with water. The plate was then immersed for 3 minutes in a 0.2% aqueous solution of potassium fluorozirconate maintained at 80° C. After washing with water and drying, the prepared solution of the diazo resin described above was coated on the surface of the aluminum plate treated as described above. The obtained printing material can be engraved using well known methods. For example, the printing material exposed for 2 minutes to a 30 amp. carbon arc lamp from a distance of 70 cm, was immersed in a solution of 20 parts by weight of isopropyl alcohol and 80 parts by weight of water. The surface was then softly rubbed with a sanitary cotton, whereby only the unexposed part was cleanly removed to reveal the hydrophilic surface and washed with water and dried. Then a solution of 7°De gum arabic was applied thereto and dried. After about 18 hours, the plate was divided longitudinally into two equal parts, and these parts were placed in the multilith 1250 type printing machine. The printing surface of one plate was wiped wth a gum removing solution of the following components (pH: 2.9), and the printing surface of the other plate was wiped with the same etching solution as in Example 1. Afterwards, the printing machine was immediately run and a wetting water roller was brought into contact with the printing surfaces of both plates.

Next, an ink roller was brought into contact with the printing surfaces with the simultaneous feeding of papers to be printed, and the number of papers used until the entire image of the prints became uniformly inked at the same image density was counted. The plate wiped with the gum removing solution reproduced uniformly inked prints after the first 5 prints, while the other plate wiped with the etching solution reproduced uniformly inked prints after the first 24 prints.

| Composition of Gum Removing Solution | |
|---|---|
| Lactic Acid (75% aqueous solution) | 100 g |
| Phosphoric Acid | 13 g |
| Sodium Pyrophosphate | 42 g |
| Carboxymethyl Cellulose | 5 g |
| Water to make | 1000 ml |

EXAMPLES 3 to 12

Every printing plate used in these Examples where gum removing solutions each of the components as shown in the following Table were used was a light-sensitive printing plate prepared in the same manner as in Example 1 and developed with the same developer as in Example 1. In Examples 3 to 7, the printing plate was placed in the multilith 1250 type prnting machine, and after the printing surface thereof was wiped with the respective gum removing solution, the printing machine was run. In this operation, papers were fed at the same time when the printing surface was brought into contact with the ink roller, and the number of papers used until a print which was uniformly inked with a sufficient ink density was first obtained was counted. In Examples 8 to 12, after the printing plate was developed with the same developer as in Example 1, the plate was fully washed with water, water was swished off, an aqueous solution of 14°Be gum arabic was applied to the plate, and after 24 hours, the plate was placed in the multilith 1250 type printing machine. After that, the procedure with the respective gum removing solution was carried out. The compositions of the gum removing solution used are shown in the following Table.

For comparison, the printing plates in Examples 3 to 7 were processed in a different manner where no gum removing solution was used and the plate was washed only with pure water. The number of papers used until a print having a uniform ink density was first obtained was 20 to 25 prints.

Also for comparison, the printing plates in Examples 8 to 12 were processed also in a different manner where the printing surface of the plate was washed only with pure water for removing the gum therefrom. The number of papers used until a print having a uniform ink density was first obtained was about 30 prints.

TABLE

| Composition (g) | Example 3 | 4 | 5 | 6 | 7 | 8 | 9 | 10 | 11 | 12 |
|---|---|---|---|---|---|---|---|---|---|---|
| Gum Arabic (14° be) | — | — | 30 | 30 | 30 | — | — | 25 | 25 | — |
| Carboxymethyl Cellulose | 7 | 7 | — | — | — | 5 | 5 | — | — | — |
| Phosphoric Acid (85%) | 7 | 7 | 5 | 3 | 5 | 6 | 5 | 5 | 4 | 5 |
| Sodium Tertiary Phosphate | — | — | 2.3 | — | 2.3 | — | — | — | 2.3 | 2.3 |
| Sodium Tripolyphosphate | 10 | 7 | — | — | — | 12 | 15 | — | — | — |
| Sodium Pyrophosphate | — | 5 | — | 8 | — | — | — | 10 | — | — |
| Lactic Acid (75%) | — | — | 60 | 72 | — | 45 | 75 | 30 | 65 | — |
| Citric Acid | 50 | — | — | — | — | — | — | 25 | 8 | — |
| 4-Butyrolactone | 20 | 65 | — | — | 90 | 15 | — | 25 | — | 78 |
| Pure Water to make | 1000 | 1000 | 1000 | 1000 | 1000 | 1000 | 1000 | 1000 | 1000 | 1000 |
| pH of Gum Removing Solution | 1.8 | 5.3 | 2.1 | 2.8 | 2.8 | 2.5 | 2.5 | 2.0 | 2.0 | 2.7 |
| Number of Papers* | 12–15 | 10–12 | 5–6 | 5–6 | 8–10 | 6–8 | 5–6 | 8–10 | 6–8 | 10–12 |

*Number of papers used until a print having a sufficient ink density was first obtained

EXAMPLE 13

A printing plate which was developed and gummed in the same manner as in Example 1 was placed in the multilith 1250 type printing machine 5 days after the treatment. After the printing surface of the plate was carefully wiped with a cellulose sponge absorbing an aqueous solution (pH: about 4) containing 23 g of a 75% lactic acid aqueous solution in 80 cc of water, the printing machine was run with the printing surface still wet. The surface of the plate was first brought into contact with a water roller, and then the surface of the plate was brought into contact with an ink roller with the simultaneous feeding of papers. Comparing the fourth or fifth print with the 1000th print, the reproductivity of the half-tone image and the uniformity of ink density were almost the same. Comparing the result of Example 1 and that of Example 13, the gum removing solution used in the latter was somewhat inferior to that used in the former with respect to the reproductivity of the half-tone image and the uniformity of the ink density.

While the invention has been described in detail and with reference to specific embodiments thereof, it will be apparent to one skilled in the art that various changes and modifications can be made therein without departing from the spirit and scope thereof.

What is claimed is:

1. A process for removing gum arabic or cellulose gum from lithographic plates comprising applying to the surface of a lithographic printing plate a gum removing solution consisting essentially of an aqueous solution of at least one compound selected from the group consisting of i. compounds selected from the group consisting of lactic acid, citric acid, tartaric acid, Rochelle salt, hydroxyacetic acid, sodium citrate, potassium citrate, ammonium citrate, sodium lactate, ammonium lactate and potassium lactate, and ii. compounds selected from the group consisting of propiolactone, butyrolactone, valerolactone, propiolactam, valerolactam, hexanolactone, pyrrolidone, methylpyrrolidone and γ-caprolactone, said aqueous solution containing 4.5 to 16.7 weight percent of said compounds selected from said group, the substantial balance of said solution being water, and said solution having a pH of about 1 to 5.5;

and removing said gum removing solution from said surface without damaging the image.

2. The process of claim 1, wherein said gum removing solution consists essentially of an aqueous solution of at least one compound selected from the group consisting of said compound (i) and said compound (ii).

3. The process of claim 1, wherein said gum removing solution consists essentially of (a) at least one compound selected from the group consisting of said compound (i), said compound (ii) and said compound (iii), and (b) at least one compound selected from the group consisting of a phosphoric acid and a polyphosphoric acid and the metal salts and the ammonium salts of these acids, said component (b) being present in an amount of about 0.3 to 15% by weight.

4. The process of claim 3, wherein said gum removing solution additionally contains (c) a water-soluble colloid selected from the group consisting of gum arabic, cellulose gum, starch and sodium aliginate, said component (c) being present in an amount of about 0.1 to 28% by weight.

5. The process of claim 3, wherein the component (b) comprises a combination of (i) at least one compound selected from the group consisting of the metal salts and the ammonium salts of phosphoric acid and the metal salts and the ammonium salts of polyphosphoric acid and (ii) phosphoric acid.

6. The process of claim 3, wherein the metal salts of component (b) are the alkali metal salts.

* * * * *